US010814466B2

(12) United States Patent
Hung et al.

(10) Patent No.: US 10,814,466 B2
(45) Date of Patent: Oct. 27, 2020

(54) NAIL GUN AND OPERATION DEVICE THEREOF

(71) Applicant: Basso Industry Corp., Taichung (TW)

(72) Inventors: Liang-Chi Hung, Taichung (TW); Li-Hsin Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 186 days.

(21) Appl. No.: 16/125,868

(22) Filed: Sep. 10, 2018

(65) Prior Publication Data

US 2019/0077000 A1 Mar. 14, 2019

(30) Foreign Application Priority Data

Sep. 14, 2017 (TW) ..... TW106131599

(51) Int. Cl.
*B25C 1/00* (2006.01)
*B25C 1/04* (2006.01)

(52) U.S. Cl.
CPC ..... *B25C 1/008* (2013.01); *B25C 1/043* (2013.01); *B25C 1/047* (2013.01)

(58) Field of Classification Search
CPC ..... B25C 1/008; B25C 1/043; B25C 1/047
See application file for complete search history.

(56) References Cited

U.S. PATENT DOCUMENTS 5,642,849 A * 7/1997 Chen ..... B25C 5/1665 227/123
6,953,137 B2 10/2005 Nakano et al.
7,004,368 B1 * 2/2006 Chen ..... B25C 1/005 227/109
2004/0222266 A1 * 11/2004 Kakuda ..... B25C 1/005 227/8
2005/0001001 A1 * 1/2005 Nakano ..... B25C 1/008 227/8
2010/0012700 A1 * 1/2010 Perron ..... B25C 1/008 227/8
2014/0197220 A1 * 7/2014 Birk ..... B25C 1/008 227/8
2018/0126531 A1 * 5/2018 Pomeroy ..... B25C 1/04

FOREIGN PATENT DOCUMENTS

CA 879401 A * 8/1971

* cited by examiner

*Primary Examiner* — Andrew M Tecco
*Assistant Examiner* — Nicholas E Igbokwe
(74) *Attorney, Agent, or Firm* — Burris Law, PLLC

(57) ABSTRACT

A nail gun includes a gun body, a power module, a muzzle module and an operation module. The muzzle module includes a contact arm resiliently maintained at a normal position. The operation module includes a transmission unit and a trigger unit. The transmission unit includes a transmission member that is connected to the contact arm. The trigger unit includes a trigger member, a trigger arm and a switch member. The trigger arm is mounted in the trigger member, and abuts against the transmission member when the trigger member is not depressed. The switch member is operable to move between a sequential firing position and a repetitive firing position.

18 Claims, 12 Drawing Sheets

NAIL GUN AND OPERATION DEVICE THEREOF

CROSS-REFERENCE TO RELATED APPLICATION

This application claims priority of Taiwanese Invention Patent Application No. 106131599, filed on Sep. 14, 2017.

FIELD

The disclosure relates to a nail gun, and more particularly to a nail gun and an operation device thereof.

BACKGROUND

A conventional nail gun disclosed in U.S. Pat. No. 6,953,137 includes a main housing, a contact arm that is movably mounted to the main housing, a trigger that is pivoted to the main housing, a trigger arm that is mounted in the trigger, and a plunger that is movably mounted in the main housing. When the contact arm is pushed against an object, a tip end portion of the trigger arm is blocked by the contact arm so that depression of the trigger drives the trigger arm to move the plunger for firing a nail. However, after the firing of the nail, the tip end portion of the trigger arm is configured to be removed from the path of movement of the contact arm, so as not to be blocked by the contact arm. Therefore, the plunger cannot be moved again for firing another nail unless the trigger is released.

SUMMARY

Therefore, an object of the disclosure is to provide a nail gun that can alleviate the drawback of the prior art.

According to the disclosure, the nail gun includes a gun body, a power module, a muzzle module and an operation module. The power module is disposed in the gun body, and is configured to perform a nail-driving operation in which the power module output power to strike a nail. The muzzle module is mounted to the gun body, and includes a nail exit opening and a contact arm. The contact arm has an abutment front end, and is resiliently maintained at a normal position. The contact arm is operable to move away from the normal position such that the abutment front end projects relative to the nail exit opening. The operation module is operable to activate the nail-driving operation for firing the nail via the nail exit opening. The operation module includes a transmission unit and a trigger unit. The transmission unit includes a transmission member that is connected to the contact arm. The trigger unit is mounted to the gun body, and includes a trigger member, a trigger arm and a switch member. The trigger arm is mounted in the trigger member, and abuts against the transmission member when the trigger member is not depressed. The switch member is operable to move between a sequential firing position and a repetitive firing position. When the switch member is at the sequential firing position and when the trigger member is depressed with the abutment front end of the contact arm not being blocked, the trigger arm is configured to push the transmission member to move the contact arm away from the normal position until the trigger arm deviates from the path of movement of the transmission member such that the nail-driving operation is prevented from being activated by operation of the contact arm.

Another object of the disclosure is to provide a operation device that can alleviate the drawback of the prior art.

According to the disclosure, the operation device is for use in a nail gun and for activating a nail-driving operation. The nail gun has a nail exit opening. The operation device includes a contact arm, a transmission member, a trigger member, a trigger arm and a switch member. The contact arm is disposed on the nail gun, and has an abutment front end. The contact arm is resiliently maintained at a normal position, and is operable to move away from the normal position such that the abutment front end projects relative to the nail exit opening. The transmission member is connected to the contact arm. The trigger member is pivoted to the nail gun. The trigger arm is mounted in the trigger member, and abuts against the transmission member when the trigger member is not depressed. The switch member is operable to move between a sequential firing position and a repetitive firing position. When the switch member is at the sequential firing position and when the trigger member is depressed with the abutment front end of the contact arm not being blocked, the trigger arm is configured to push the transmission member to move the contact arm away from the normal position until the trigger arm deviates from the path of movement of the transmission member such that the nail-driving operation is prevented from being activated by operation of the contact arm.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
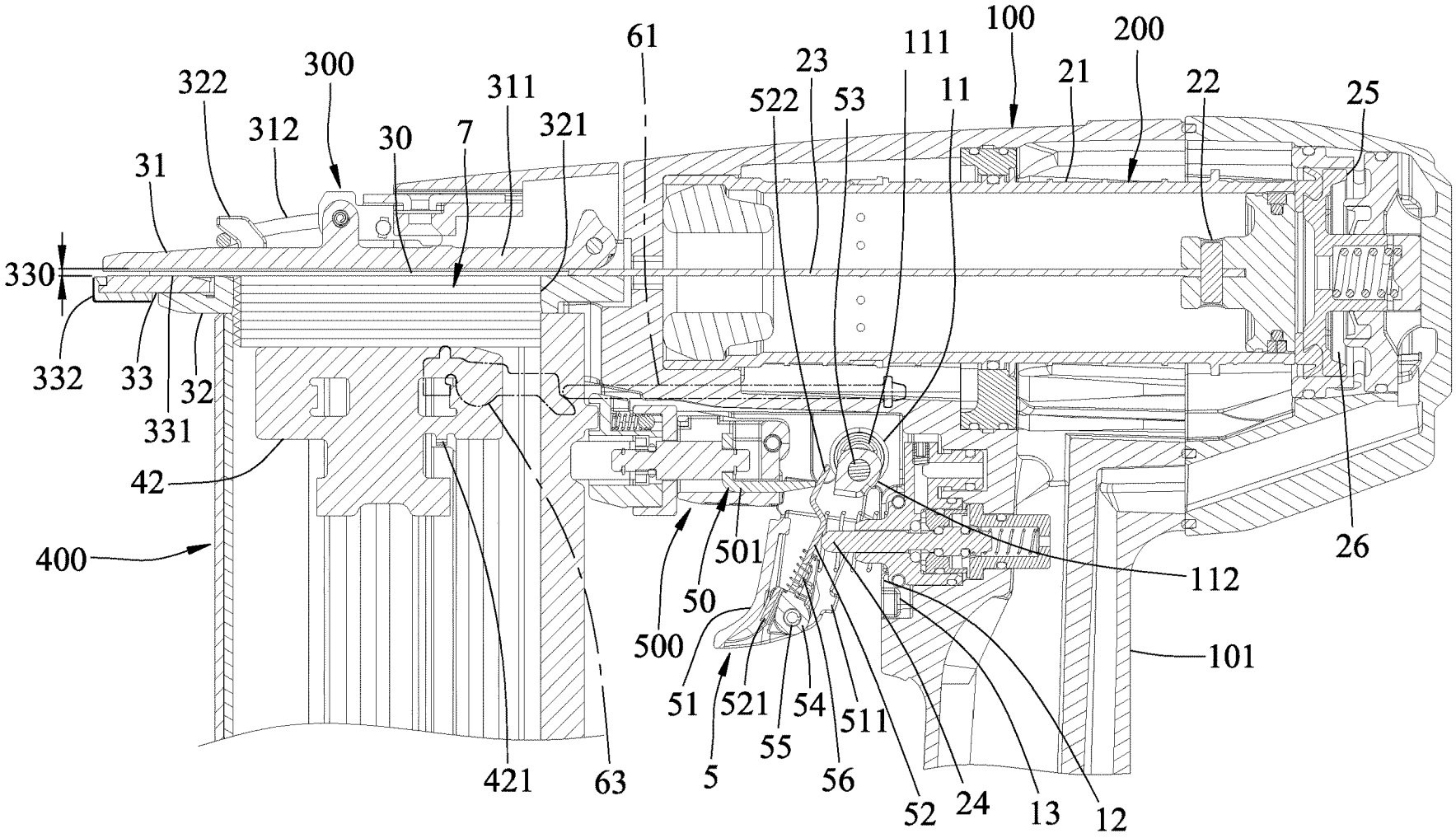
FIG. 1 is a fragmentary sectional view illustrating an embodiment of the nail gun according to the disclosure.
Figure 2:
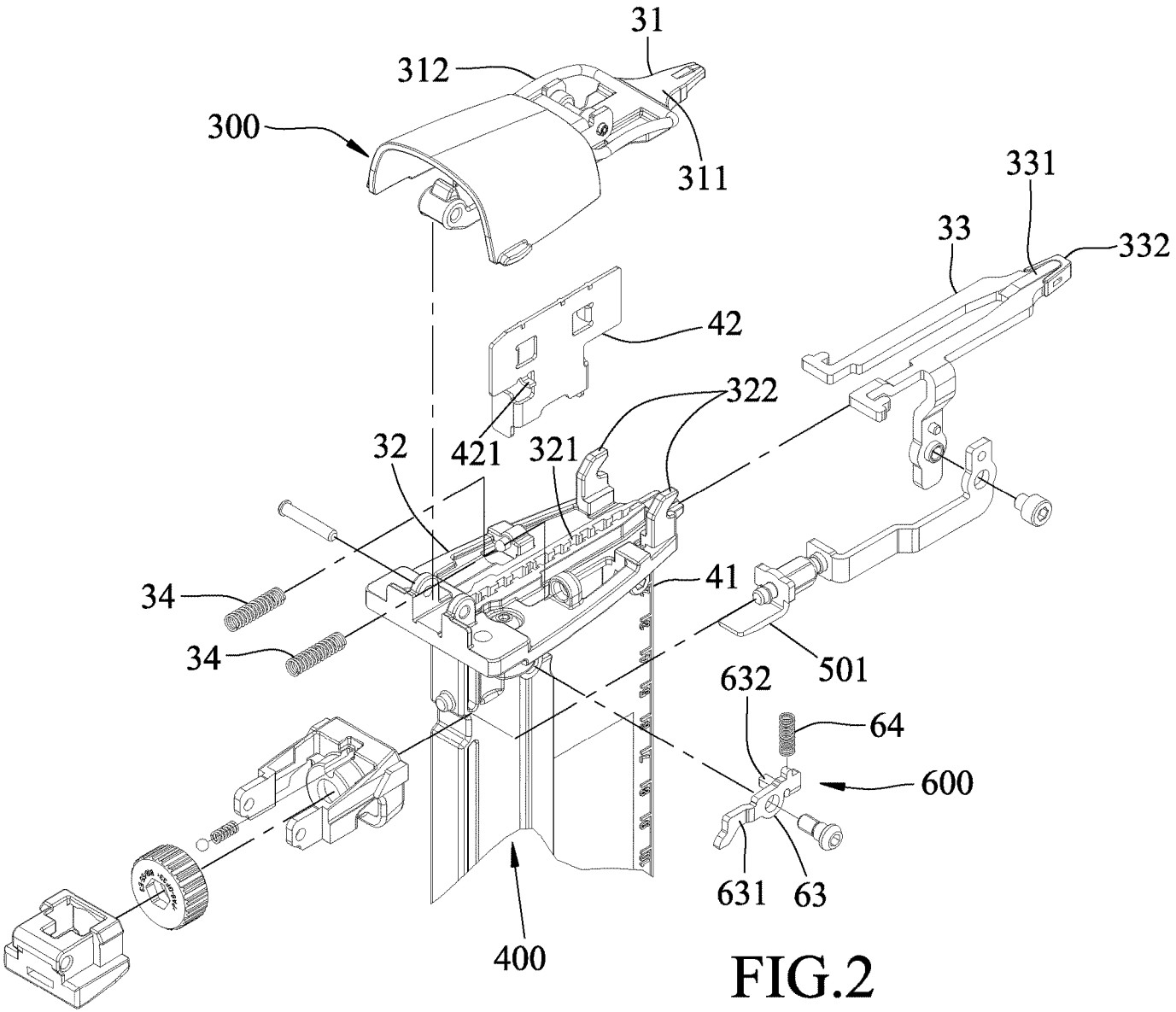
FIG. 2 is a fragmentary, partly exploded perspective view illustrating a muzzle module of the embodiment.
Figure 3:
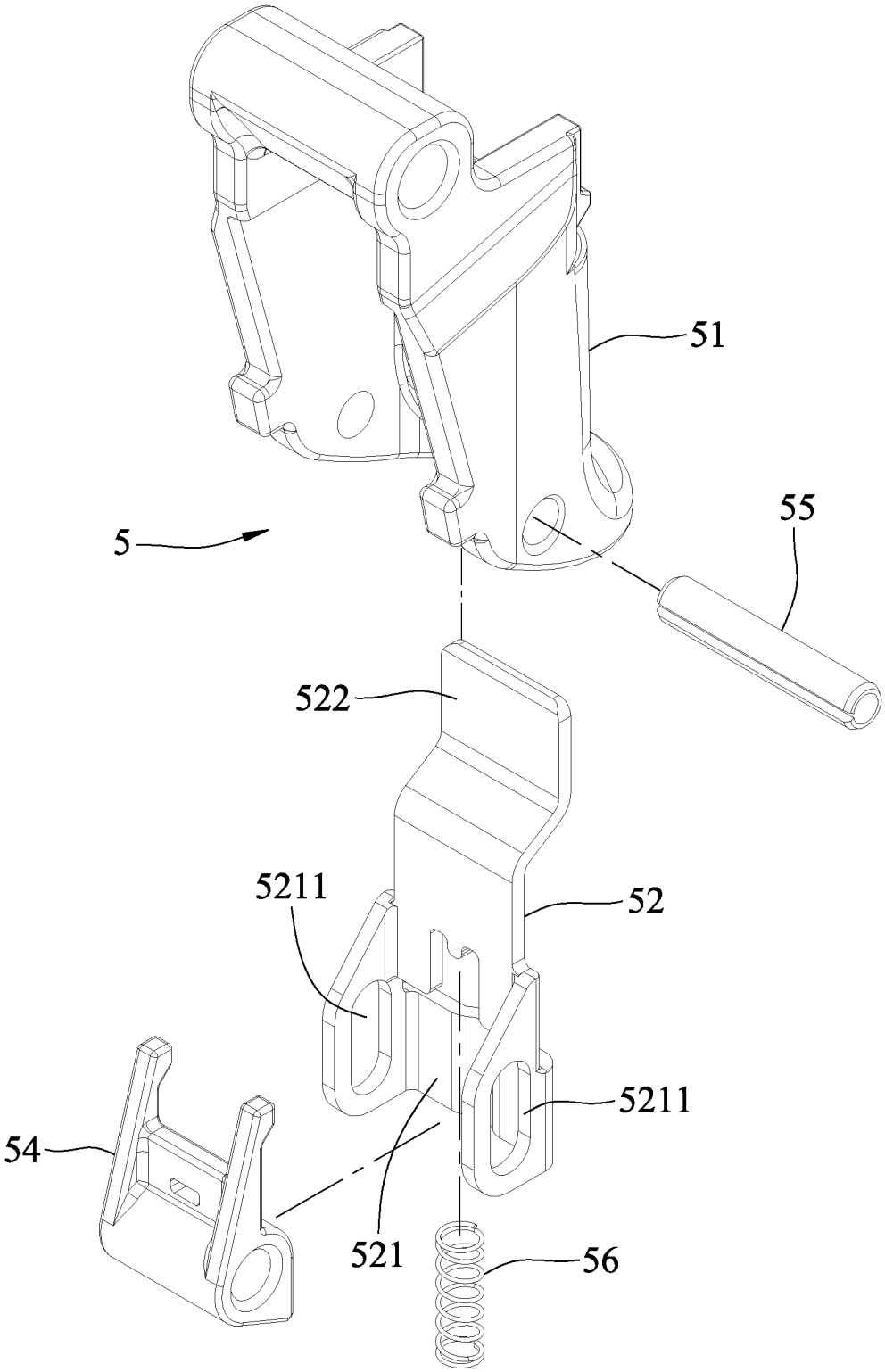
FIG. 3 is an exploded perspective view illustrating a portion of a trigger unit of the embodiment.
Figure 4:
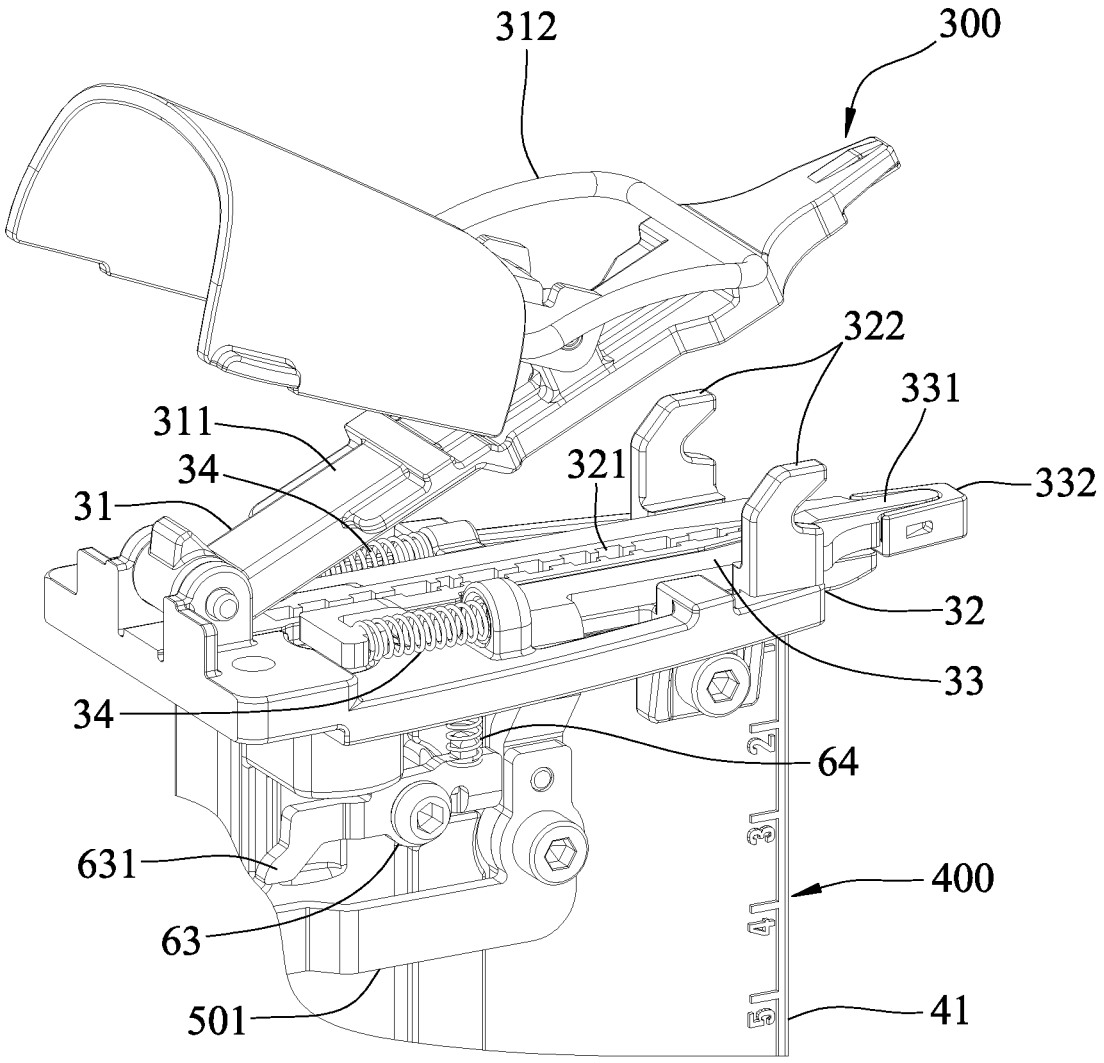
FIG. 4 is a fragmentary perspective view illustrating the muzzle module.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 11:
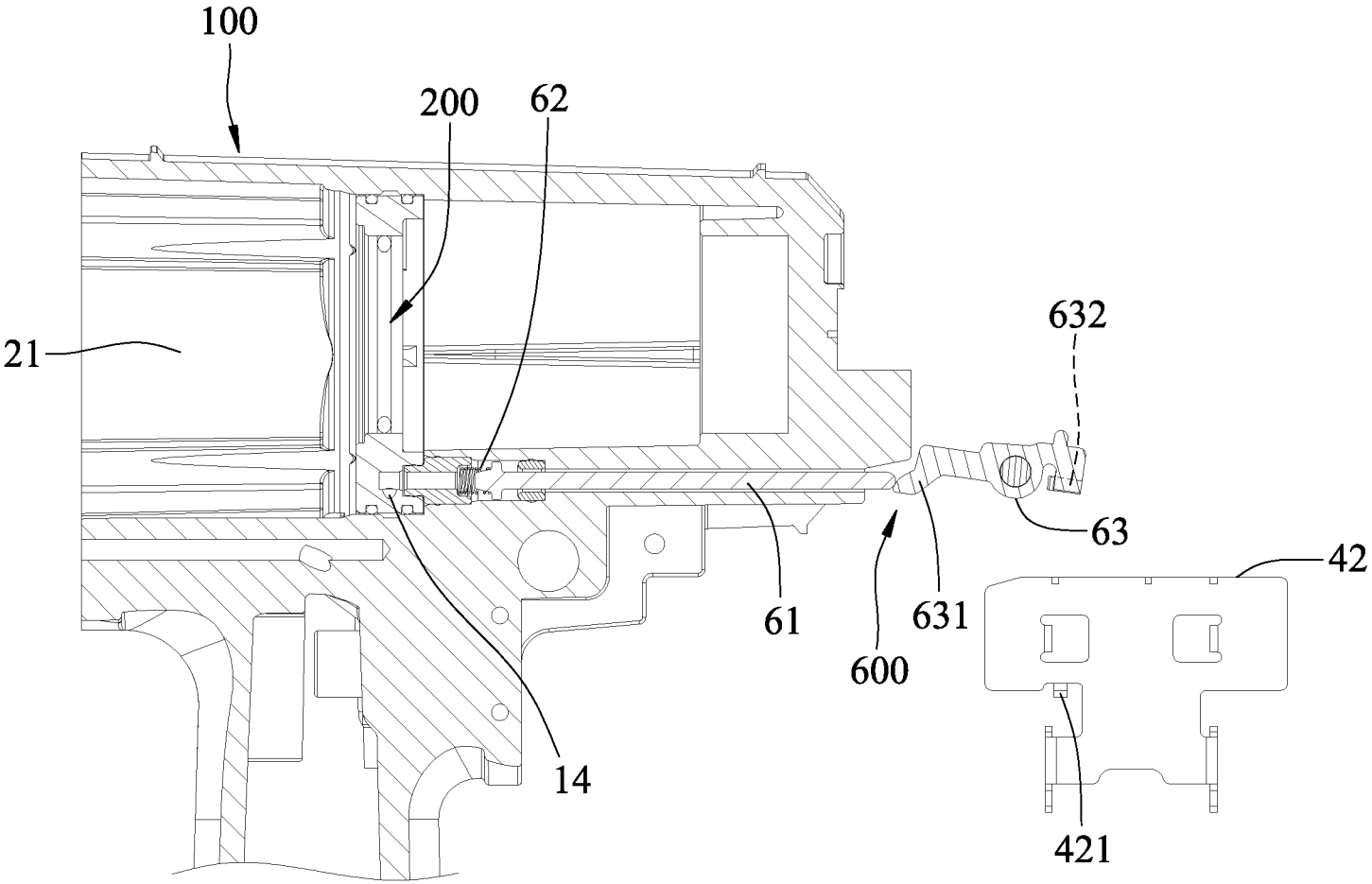
FIG. 11 is a fragmentary sectional view illustrating a detection nodule of the embodiment.

Referring to FIGS. 1 to 4, the embodiment of the nail gun includes a gun body 100, a power module 200, a muzzle module 300, a magazine module 400, an operation module 500 and a detection module 600 (see FIG. 11). The gun body 100 has a handle 101. For convenience sake, in the following paragraphs, the handle 101 is denoted as the lower portion of the nail gun, the muzzle module 300 is denoted as the front portion of the nail gun, and the rest can be deduced by analogy.

The gun body 100 further has a positioning hole 11 that is disposed adjacent to the handle 101, a first stop structure 12, a second stop structure 13 that is disposed below the first stop structure 12, and a flow path 14 (see FIG. 11) that is disposed adjacent to the magazine module 400. The positioning hole 11 has an upper positioning portion 111 and a lower positioning portion 112. The second stop structure 13 is recessed rearwardly relative to the first stop structure 12 away from the muzzle module 300. In one embodiment, the first stop structure 12 is configured as a plane, and the second stop structure 13 is configured as a recess.

The power module 200 is disposed in the gun body 100, and is configured to perform a nail-driving operation in which the power module 200 output power to strike a nail. In one embodiment, the power module 200 uses high-pressure air as the power source, and includes a cylinder 21 that is mounted in the gun body 100, a piston 22 that is movably disposed in the cylinder 21, a drive bit 23 that is co-movably mounted to the piston 22, a plunger 24 that is operable for introducing the high-pressure air into the cylinder 21, a head valve 25 that removably blocks the cylinder 21, and a release chamber 26 that is defined between the head valve 25 and the gun body 100 and that is in communication with the flow path 14 (see FIG. 11).

When the plunger 24 is not operated (see FIG. 1), the head valve 25 is biased by the high-pressure air in the release chamber 26 to block the cylinder 21 so that the high-pressure air cannot flow into the cylinder 21. When the plunger 24 is operated to move to an activating position (see FIG. 7), the high-pressure air in the release chamber 26 is released via the flow path 14 so that the head valve 25 unblocks the cylinder 21 and that the high-pressure air flows into the cylinder 21 to push the piston 22 and the drive bit 23 for striking nails (i.e., the nail-driving operation is activated). The abovementioned operation is the same as that of a conventional pneumatic nail gun. In one embodiment, the power module 200 may use gas as the power source. The operation of a gas nail gun is well-known to one having ordinary skill in the art, and is not further described in the following paragraphs.

The muzzle module 300 is mounted to a front portion of the gun body 100. In one embodiment, the muzzle module 300 includes a cover plate 31, a middle plate 32 that cooperates with the cover plate 31 to define a nail path 30 therebetween, a contact arm 33 that is substantially disposed between the cover plate 31 and the middle plate 32 and that is movable in a front-rear direction relative to the gun body 100, and two safety resilient members 34. The cover plate 31 includes a plate member 311, and a fastening assembly 312 that is pivoted to the plate member 311. The middle plate 32 has a nail entrance opening 321, and two hook portions 322 that are respectively located at two opposite lateral sides of the cover plate 31. The hook portions 322 can be separably held by the fastening assembly 312 so that the cover plate 31 is removably positioned relative to the middle plate 32. The contact arm 33 has an upper surface 331 that cooperates with the cover plate 31 to define a nail exit opening 330, and an abutment front end 332. Each of the safety resilient members 34 has two opposite ends respectively abutting against the contact arm 33 and the middle plate 35, and resiliently biases the contact arm 33 rearwardly for maintaining the contact arm 33 at a normal position.

The magazine module 400 includes a magazine housing 41 that is connected to the muzzle module 300 and that is adapted to receive a plurality of nails 7 therein, and a nail feeder 42 that is movably disposed in the magazine housing 41 and that pushes the nails 7 toward the nail entrance opening 321 for moving the nails 7 into the nail path 30 one at a time. The nail feeder 12 has a projection 421 that projects toward the outside of the magazine housing 41.

The operation module 500 is operable to activate the abovementioned nail-driving operation for firing the nail 7 in the nail path 30 via the nail exit opening 330. The operation module 500 includes a transmission unit 50 and a trigger unit 5.

The transmission unit 50 includes a transmission member 501 that is connected to the contact arm 33.

The trigger unit 5 is mounted to the gun body 100, and includes a trigger member 51, a trigger arm 52, a switch member 53, an abutment member 54, a arm pivot shaft 55 and a trigger resilient member 56.

The trigger member 51 has an abutment portion 511 that faces rearwardly. The abutment portion 511 is operable to correspond in position to the first stop structure 12 or the second stop structure 13.

The trigger arm 52 has a lower portion 521 that is connected to the trigger member 51, and an upper portion 522 that is opposite to the lower portion 521. The lower portion 521 is formed with two slots 5211. When the trigger member 51 is not depressed, the upper portion 522 of the trigger arm 52 is located on the path of movement of the transmission member 501, and abuts against a rear end of the transmission member 501.

The switch member 53 is rotatably mounted to the trigger member 51, and is movably mounted to the positioning hole 11 of the gun body 100. The switch member 53 is operable to move between a sequential firing position (see FIGS. 1 and 5 to 7) where the switch member 53 is positioned relative to the gun body 100 at the lower positioning portion 112 of the positioning hole 11, and a repetitive firing position (see FIGS. 8 to 10) where the switch member 53 is positioned relative to the gun body 100 at the upper positioning portion 111 of the positioning hole 11. When the switch member 53 is moved from the sequential firing position to the repetitive firing position, the trigger member 51 and the trigger arm 52 are moved upwardly. The abutment portion 511 of the trigger member 51 corresponds in position to the first stop structure 12 when the switch member 53 is at the repetitive firing position, and corresponds in position to the second stop structure 13 when the switch member 53 is at the sequential firing position. In one embodiment, the switch member 53 may be mounted to the positioning hole 11 via a mounting seat that is rotatably mounted in the positioning hole 11 and that has an eccentric rod portion on which the switch member 53 is rotatably mounted.

The abutment member 54 is pivoted to the trigger arm 52.

The arm pivot shaft 55 extends through the abutment member 54 and the slots 5211 of the trigger arm 52, and is pivoted to the trigger member 51, so that the trigger arm 52 and the abutment member 54 are pivotable relative to the trigger member 51.

The trigger resilient member 56 has two opposite ends respectively abutting against the abutment member 54 and the trigger arm 52, and resiliently biases the trigger arm 52 upwardly away from the arm pivot shaft 55. The arm pivot shaft 55 is movable along the slots 5211 of the trigger arm 52, so that the trigger arm 52 is movable relative to the abutment member 54 and the arm pivot shaft 55.

Figure 12:
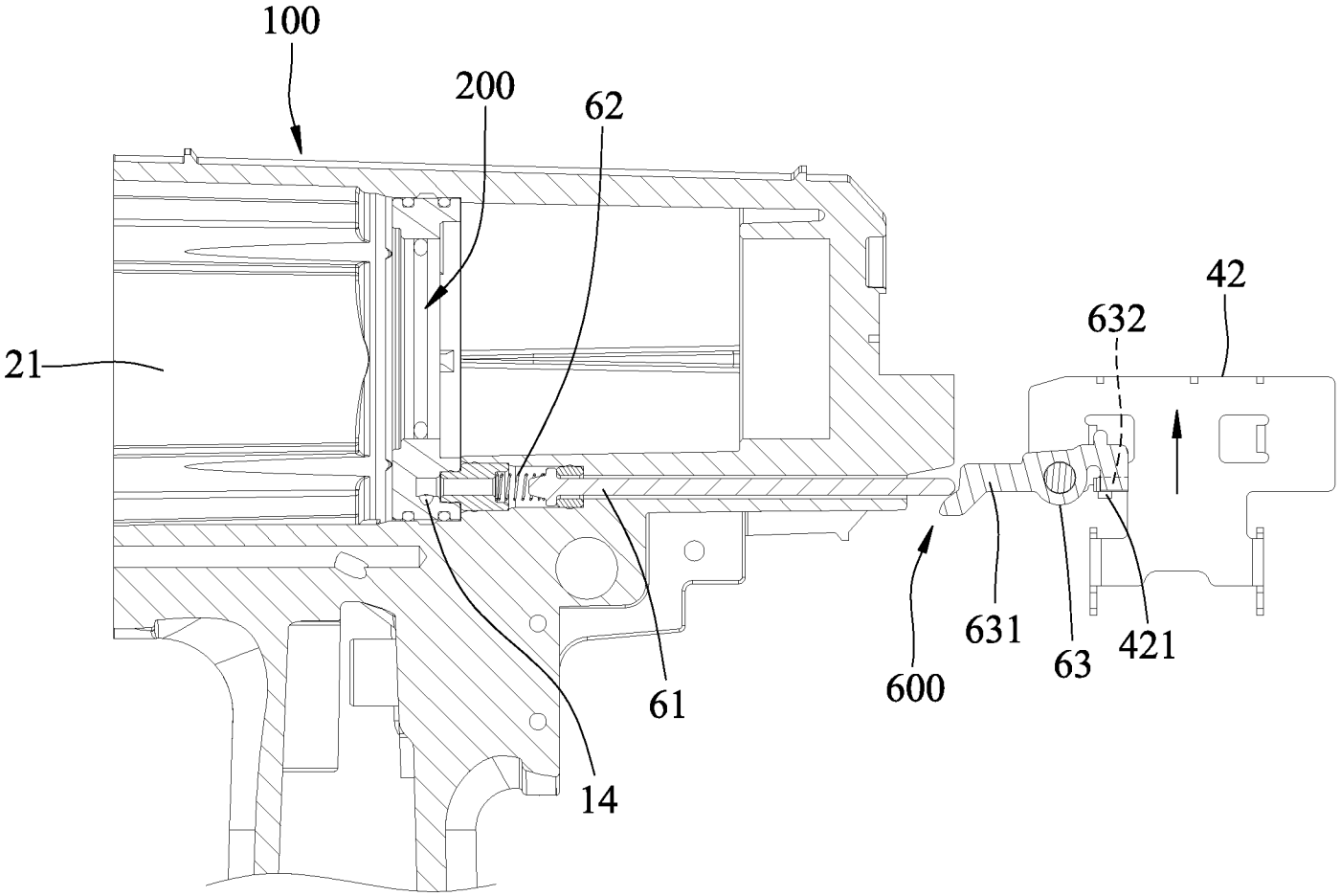
FIG. 12 is another fragmentary sectional view illustrating the detection nodule being pushed by a nail feeder of the embodiment.

Referring to FIGS. 1, 11 and 12, the detection module 600 includes a valve rod 61 that is mounted to the gun body 100 and that is movable between an unsealing position (see FIG. 11) and a sealing position (see FIG. 12), a valve resilient member 62 that has two opposite ends respectively abutting against the gun body 100 and the valve rod 61, a detection member 63 that is disposed on the magazine housing 41, and a detection resilient member 64 (see FIG. 2) that has two opposite ends respectively abutting against the detection member 63 and the middle plate 32. When the valve rod 61 is at the unsealing position, the flow path 14 is unsealed, so the high-pressure air in the release chamber 26 can be released via the flow path 14 upon movement of the plunger 24 to the activating position. When the valve rod 61 is at the sealing position, the flow path 14 is sealed, so the high-pressure air in the release chamber 26 cannot be released. The valve resilient member 62 resiliently biases the valve rod 61 toward the sealing position. The detection member 63 is pivoted to the magazine housing 61, and has a first arm portion 631, and a second arm portion 632 that is located on the path of movement of the projection 421 of the nail feeder 42. The detection resilient member 64 resiliently biases the second arm portion 632 such that when the projection 421 of the nail feeder 42 is spaced apart from the second arm portion 632, the first arm portion 631 pushes the valve rod 61 against the biasing action of the valve resilient member 62 to maintain the valve rod 61 at the unsealing position. When the amount of the nails 7 in the magazine housing 41 is less than a predetermined number, the projection 421 of the nail feeder 42 pushes and moves the second arm portion 632 against the biasing action of the detection resilient member 64 such that the first arm portion 631 is partially removed from the path of movement of the valve rod 61 and that the valve rod 61 is moved to and maintained at the sealing position by the valve resilient member 62.

When the trigger member 51 is not depressed (see FIGS. 1 and 8), the contact arm 33 is maintained at the normal position by the safety resilient members 34.

Referring to FIG. 1, when the trigger member 51 is not depressed and when the switch member 53 is at the sequential firing position, a relative small portion of the trigger arm 52 is located above the rear end of the transmission member 501.

Figure 5:
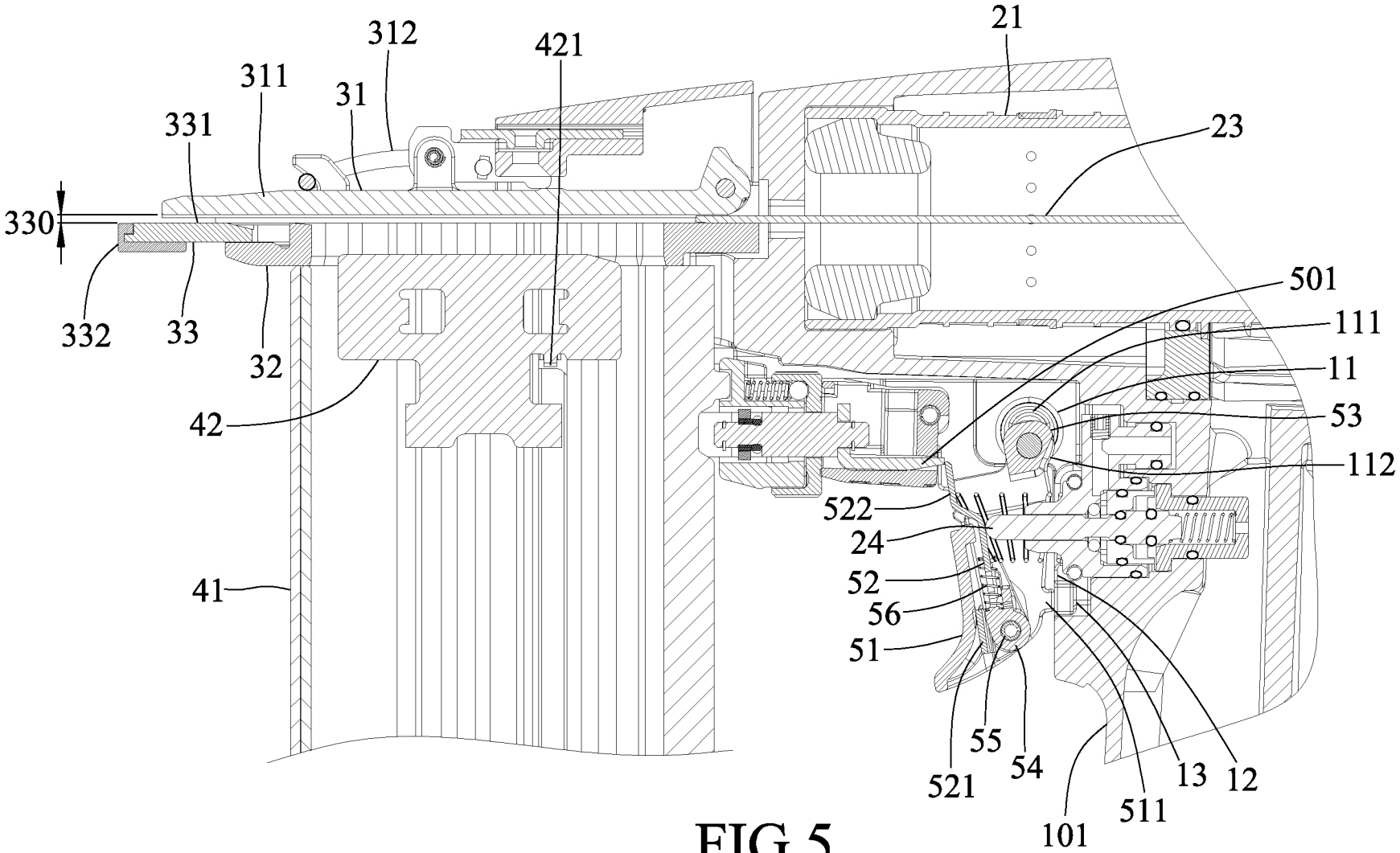
FIGS. 5 to 10 are fragmentary sectional views illustrating operation of the embodiment.

Referring to FIG. 5, when the switch member 53 is at the sequential firing position and when the trigger member 51 is depressed toward to handle 101 with the abutment front end 332 of the contact arm 33 not being pushed against an object (i.e., the contact arm 33 is not blocked), the trigger arm 52 is blocked by the plunger 24 and substantially rotates about a front end of the plunger 24, so that the upper port on 522 of the trigger arm 52 rotates forwardly to push and move the contact arm 33 and the transmission member 501 forwardly against the biasing action of the safety resilient members 34 such that the abutment front end 332 of the contact arm 33 projects relative to the nail exit opening 330.

Figure 6:
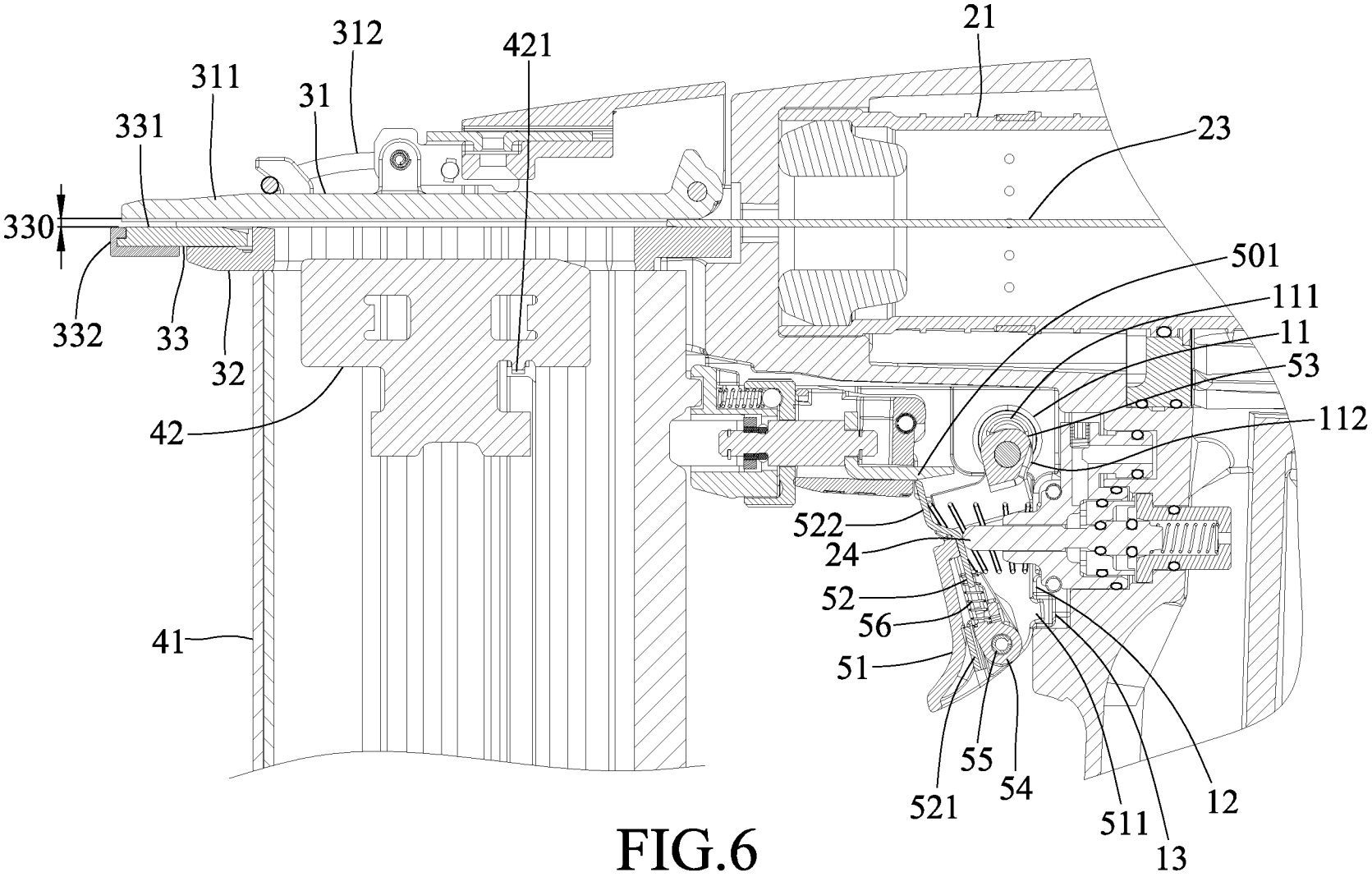

Referring to FIG. 6, with further movement of the trigger member 51 upon the depression, the upper portion 522 of the trigger arm 52 rotates to deviate from the path of movement of the transmission member 501, and the contact arm 33 is biased back to the normal position by the safety resilient members 34. As such, the plunger cannot be moved to the activating position for activating the nail-driving operation. When the trigger member 51 is released, the upper portion 522 of the trigger arm 52 first rotate rearwardly about the front end of the plunger 24 until the upper portion 522 moves past the rear end of the transmission member 501, then the trigger resilient member 56 biases the trigger arm 52 upwardly to the state shown in FIG. 1.

Figure 7:
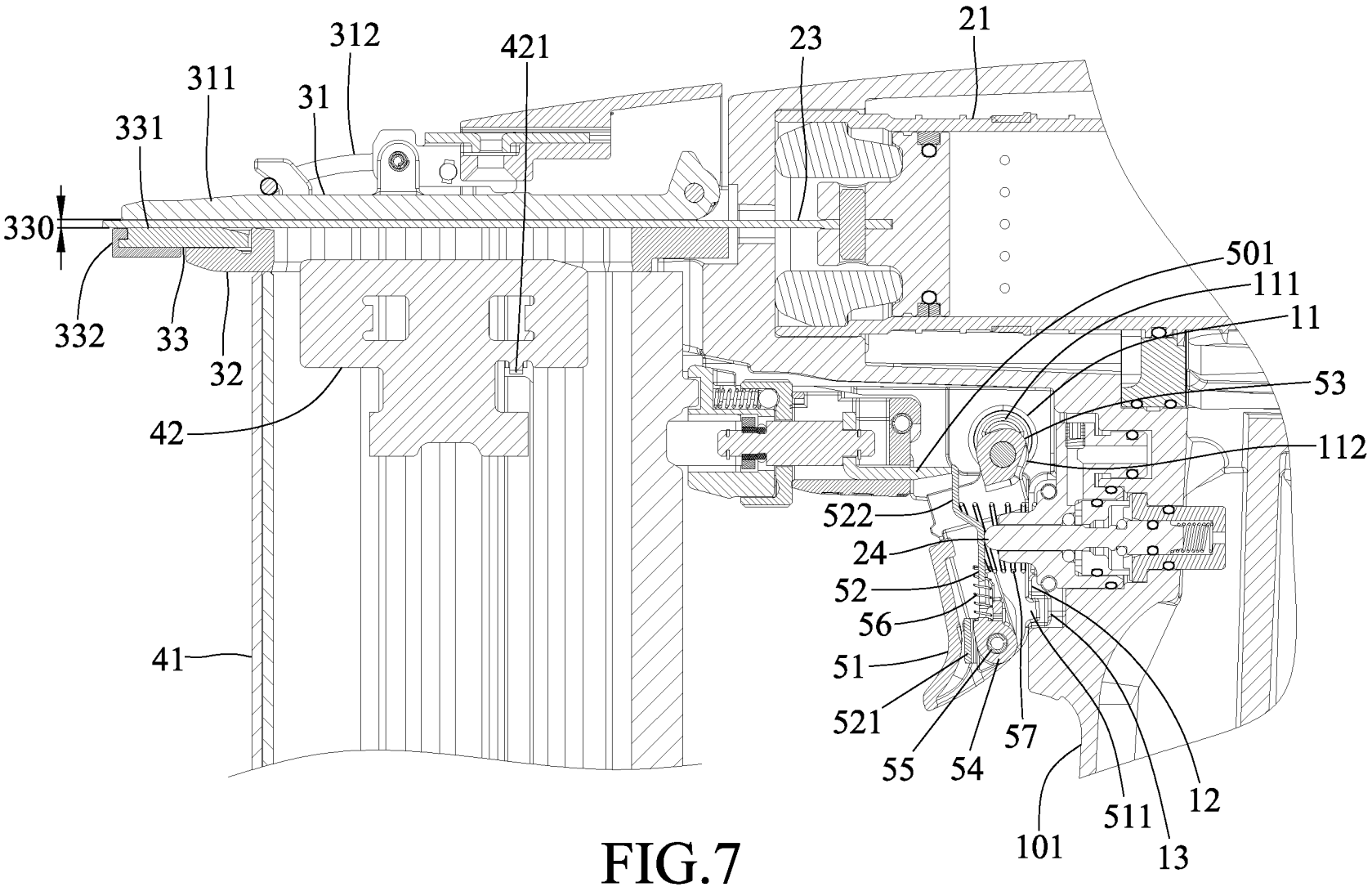

Referring to FIG. 7, when the switch member 53 is at the sequential firing position and when the trigger member 51 is depressed toward the handle 101 with the abutment front end 332 of the contact arm 33 being pushed against an object (not shown) (i.e., the contact arm 33 is not blocked), the trigger arm 52 is blocked by the rear end of the transmission member 501 and substantiality rotates about the rear end of the transmission member 501, so that the lower portion 521 of the trigger arm 52 rotates rearwardly to push and move the plunger 24 to the activating position for activating the nail-driving operation. Since the second stop structure 13 is recessed rearwardly relative to the first stop structure 12, when the switch member 53 is at the sequential firing position, the trigger member 51 is permitted to rotate by a relatively large range to abut against the second stop structure 13 so that the trigger arm 52 can sufficiently move the plunger 24 to the activating position.

When the nail-driving operation is activated, the high-pressure air flows into the cylinder 21 to push and move the piston 22 and the drive bit 23 for firing the nail 7 in the nail path 30 via the nail exit opening 330.

At the instant that the nail 7 is struck, the nail gun would be moved away from the object by a reaction force. When the trigger member 51 is kept being depressed, the trigger arm 52 is pushed forwardly by the plunger 24 and an auxiliary resilient member 57 (see FIG. 7) so that the upper portion 522 of the trigger arm 52 rotates about the arm pivot shaft 55 during the abovementioned movement of the nail gun away from the object. The trigger arm 52 first pushes and moves the contact arm 33 and the transmission member 501 forwardly against the biasing action of the safety resilient members 34 until the trigger arm 52 deviates from the path of movement of the transmission member 501. Then, the safety resilient members 39 bias the contact arm 33 back to the normal position, and the trigger arm 52 abuts against a bottom portion of the transmission member 501, as shown in FIG. 6, such that the plunger 24 cannot be moved again to activate the nail-driving operation unless the trigger member 51 is released (i.e., the nail gun is in a sequential firing mode).

Figure 8:
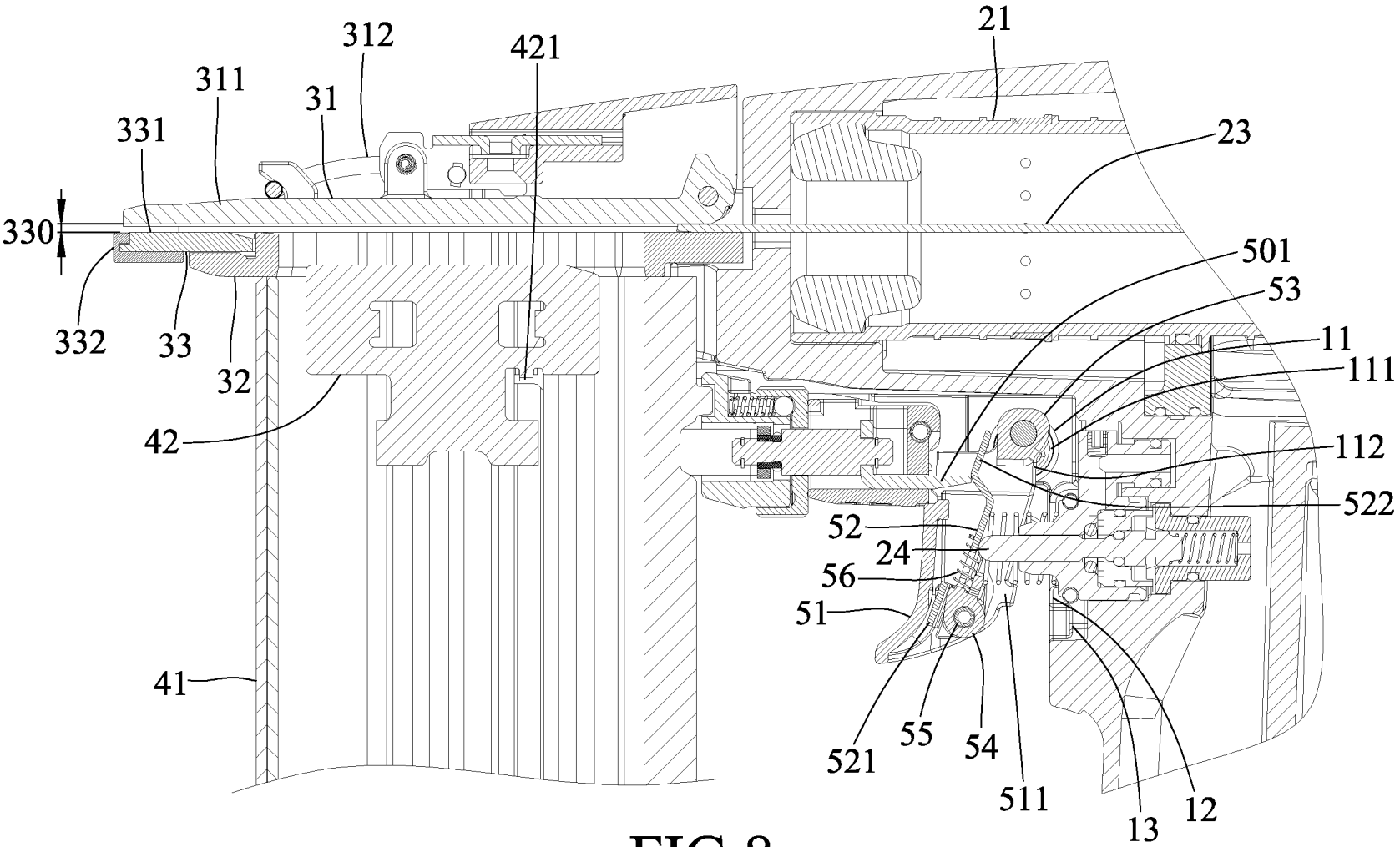

Referring to FIG. 8, when the trigger member 51 is not depressed and when the switch member 53 is at the repetitive firing position, a relative large portion of the trigger arm 52 is located above the rear end of the transmission member 501 (compared with FIG. 1).

Figure 9:
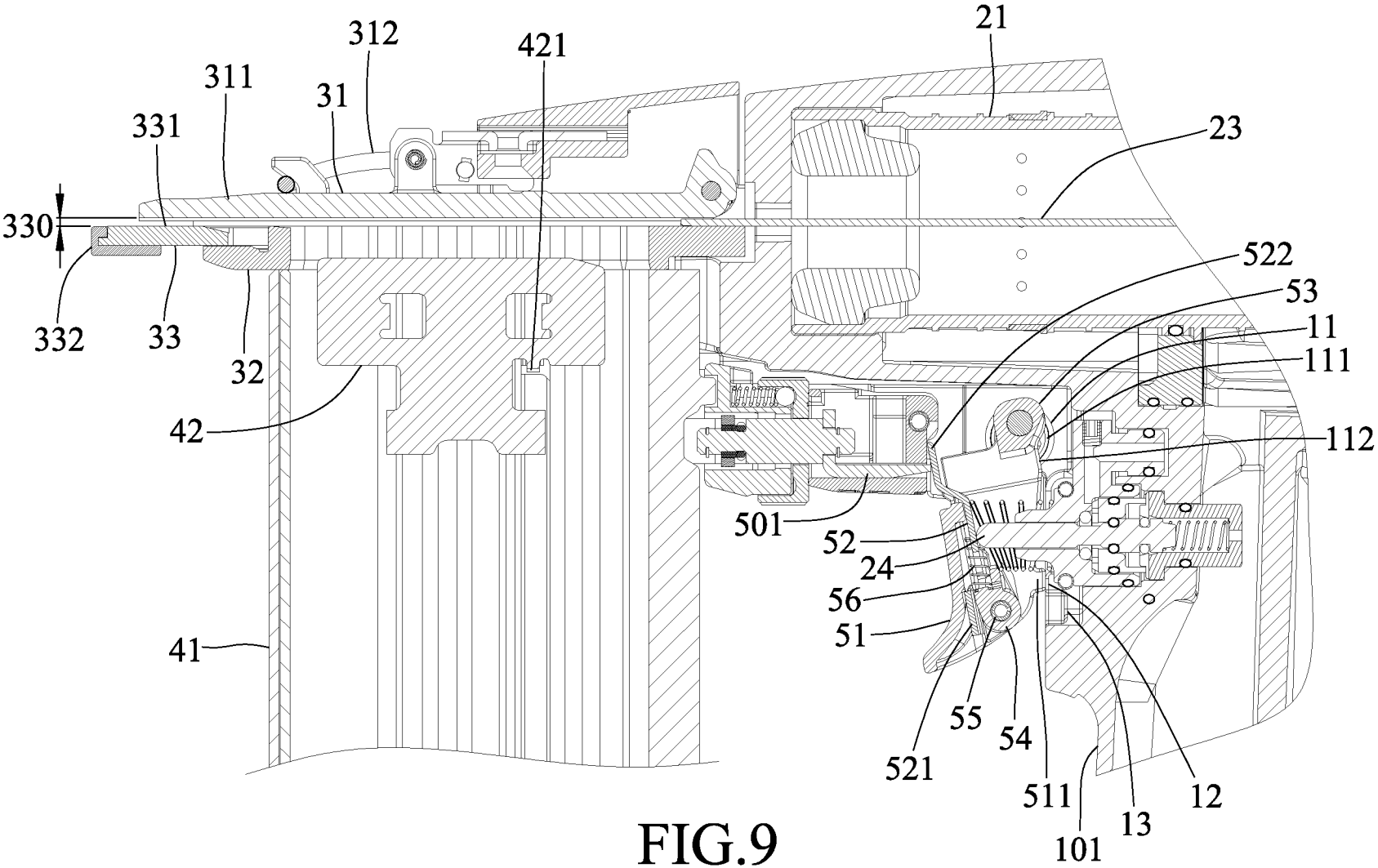

Referring to FIG. 9, when the switch member 53 is at the repetitive firing position and when the trigger member 51 is depressed toward to handle 101 with the abutment front end 332 of the contact arm 33 not being pushed against an object, the trigger arm 52 is blocked by the plunger 24 and substantially rotates about the front end of the plunger 24, so that the upper portion 522 of the trigger arm 52 rotates forwardly to push and move the contact arm 33 and the transmission member 501 forwardly against the biasing action of the safety resilient members 34. Since the trigger arm 52 has a relative large portion located above the rear end of the transmission member 501 at the time that the switch member 53 is at the repetitive firing position, when the trigger member 51 is depressed such that the abutment portion 511 abuts against the first stop structure 12, the trigger arm is still located on the path of movement of the transmission member 501, and the contact arm 33 is moved forwardly away from the normal position.

Figure 10:
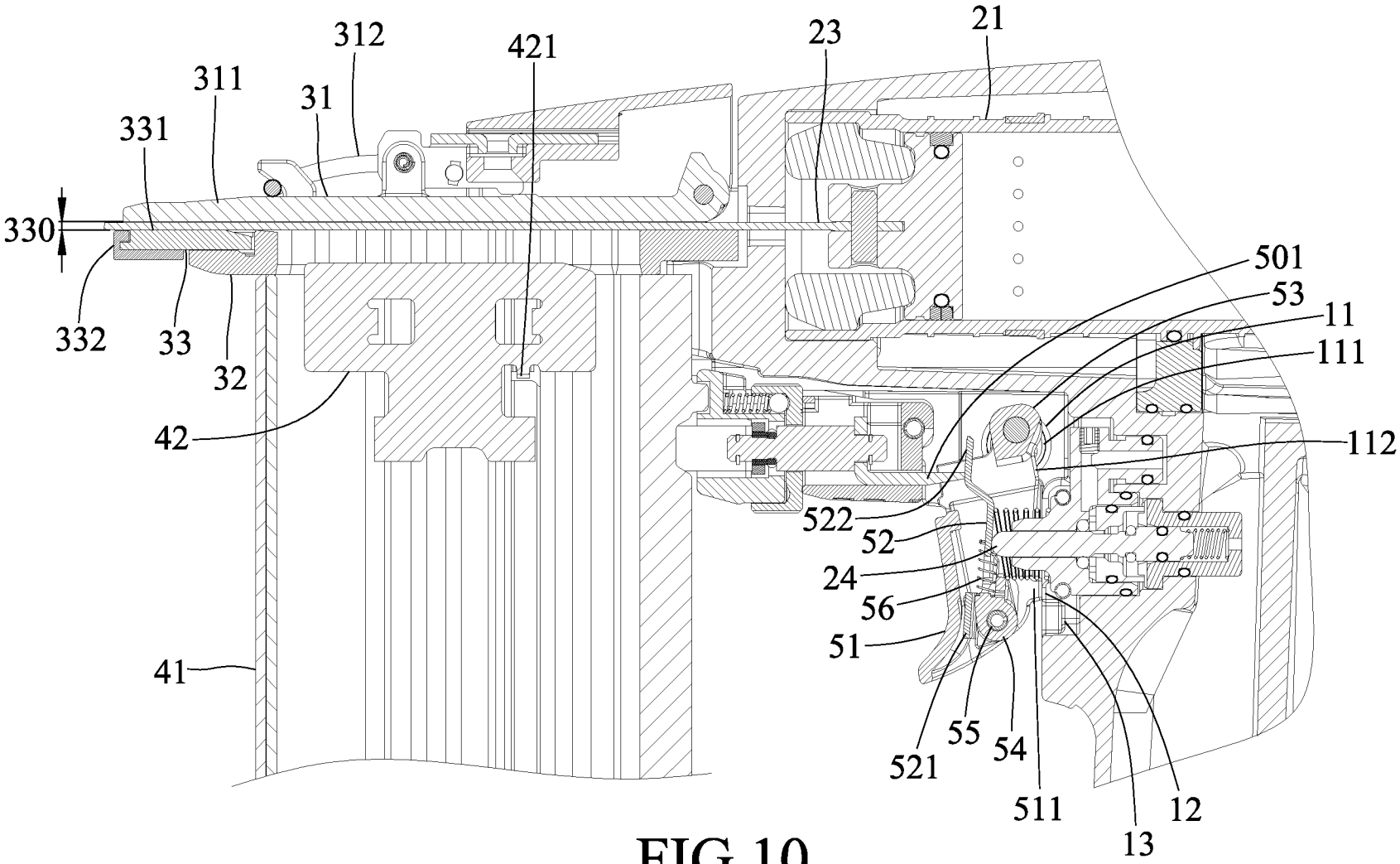

Referring further to FIG. 10, when the switch member 53 is at the repetitive firing position and when the contact arm 33 is pushed against an object (not shown) to be depressed with the trigger member 51 being kept being depressed, the trigger arm 52 is pushed by the rear end of the transmission member 501 to rotates about the arm pivot shaft 55, so that the trigger arm 52 pushes and moves the plunger 24 to the activating position for activating the nail-driving operation.

During the movement of the nail gun away from the object at the instant that the nail 7 is struck, the trigger arm 52 is pushed forwardly by the plunger 24 so that the upper portion 522 of the trigger arm 52 rotates about the arm pivot shaft 55 to push and move the contact arm 33 and the transmission member 501 forwardly against the biasing action of the safety resilient members 34. It should be noted that, since the trigger arm 52 has a relative large portion located above the rear end of the transmission member 501, after the contact arm 33 is moved by the trigger arm 52 to project out of the gun body 100 by a maximum extent, the trigger arm 52 is still located on the path of movement of the transmission member 501. As such, the plunger 24 can be repetitively moved to the activating position for activating the nail-driving operation upon each depression of the contact arm 33 with the trigger member 51 being kept being depressed (i.e., the nail gun is in a repetitive firing mode).

Since the first stop structure 12 is located ahead of the second stop structure 13, when the switch member 53 is at the repetitive firing position, the trigger member 51 is only permitted to be rotated in a relatively small range so that the trigger arm 52 cannot move the plunger 24 to the activating position when the contact arm 33 is not pushed against an object.

Referring to FIGS. 1, 11 and 12, when the nail feeder 42 pushes the last nail 7 in the magazine housing 41 into the nail path 30, the projection 421 of the nail feeder 42 pushes and moves the second arm portion 632 against the biasing action of the detection resilient member 64, such that the first arm portion 631 is partially removed from the path of movement of the valve rod 61, and that the valve rod 61 is moved to the sealing position by the valve resilient member 62 to seal up the flow path 14. As such, even if the plunger 24 is moved to the activating position, the high-pressure air in the release chamber 26 cannot be released via the flow path 14 so that the head valve 25 keeps blocking the cylinder 21 and that the high-pressure air cannot flows into the cylinder 21 for striking nails (i.e., the nail-driving operation cannot be activated). Therefore, dry-firing of the nail gun can be prevented.

It should be noted that, in this embodiment, the magazine module 400 and the detection module 600 are configured such that the flow path 14 is sealed so as to prevent dry-firing when there is no nail in the magazine housing 41. In a modification, the magazine module 400 and the detection module 600 may be configured such that the flow path 14 is sealed when the amount of the nails 7 in the magazine housing 41 is less than a predetermined number.

To sum up, the switch member 53 is operable to move the trigger arm 52 relative the transmission member 501 so as to switch the nail gun between the sequential firing mode and the repetitive firing mode. Moreover, the first stop structure 12 and the second stop structure 13 are respectively configured to limit the movement of the trigger member 51 when the switch member 53 is at the repetitive ring position and the sequential firing position. As such, the plunger 24 can be adequately moved by the trigger arm 52 when the nail gun is at the sequential faring mode or the repetitive firing mode.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A nail gun comprising:

a gun body;

a power module disposed in said gun body, and configured to perform a nail-driving operation in which said power module output power to strike a nail;

a muzzle module mounted to said gun body, and including a nail exit opening and a contact arm, said contact arm having an abutment front end, and being resiliently maintained at a normal position, said contact arm being operable to move away from the normal position such that said abutment front end projects relative to said nail exit opening; and an operation module operable to activate the nail-driving operation for firing the nail via said nail exit opening, said operation module including a transmission unit and a trigger unit, said transmission unit including a transmission member that is connected to said contact arm, said trigger unit being mounted to said gun body, and including a trigger member, a trigger arm and a switch member, said trigger arm being mounted in said trigger member, and abutting against said transmission member when said trigger member is not depressed, said switch member being operable to move between a sequential firing position and a repetitive firing position, when said switch member is at the sequential firing position and when said trigger member is depressed with said abutment front end of said contact arm not being blocked, said trigger arm being configured to push said transmission member to move said contact arm away from the normal position until said trigger arm deviates from the path of movement of said transmission member such that the nail-driving operation is prevented from being activated by operation of said contact arm;

wherein when said switch member is at the repetitive firing position and when said trigger member is depressed with said abutment front end of said contact arm not being blocked, said trigger arm being configured to push said transmission member to move said contact arm away from the normal position and configured not to deviate from the path of movement of said transmission member, such that said trigger arm is moved by said transmission member to activate the nail-driving operation upon each movement of said contact arm back toward the normal position.

2. The nail gun as claimed in claim 1, wherein when said switch member is at the sequential firing position and when said trigger member is depressed with said abutment front end of said contact arm being blocked, said trigger arm is blocked by said transmission member, and moves to activate the nail-driving operation.

3. The nail gun as claimed in claim 1, wherein said gun body has a positioning hole, said positioning hole having an upper positioning portion and a lower positioning portion, said switch member being rotatably mounted to said trigger member, and being movably mounted to said positioning hole of said gun body, said switch member being positioned relative to said gun body at said lower positioning portion of said positioning hole when said switch member is at the sequential firing position, said switch member being positioned relative to said gun body at said upper positioning portion of said positioning hole when said switch member is at the repetitive firing position, said trigger member and said trigger arm being moved relative to said gun body when said switch member is moved from the sequential firing position to the repetitive firing position.

4. The nail gun as claimed in claim 1, wherein said muzzle module includes a cover plate, and a middle plate that cooperates with said cover plate to define a nail path therebetween, said contact arm being substantially disposed between said cover plate and said middle plate, and cooperating with said cover plate to define said nail exit opening, said nail path being adapted for receiving a nail that is pushed thereinto.

5. The nail gun as claimed in claim 4, wherein said cover plate includes a plate member, and a fastening assembly that is pivoted to said plate member, said middle plate being separably held by said fastening assembly so that said cover plate is removably positioned relative to said middle plate.

6. The nail gun as claimed in claim 5, wherein said middle plate has two hook portions that are respectively located at two opposite lateral sides of said cover plate, said hook portions being separably held by said fastening assembly.

7. The nail gun as claimed in claim 4, wherein said muzzle module further includes at least one safety resilient members, said at least one safety resilient members having two opposite ends respectively abutting against said contact arm and said middle plate, said at least one safety resilient members resiliently biasing said contact arm for maintaining said contact arm at the normal position.

8. The nail gun as claimed in claim 1, wherein said trigger unit further includes an abutment member, an arm pivot shaft and a trigger resilient member, said trigger arm having a lower portion that is connected to said trigger member, and an upper portion that is opposite to said lower portion, said lower portion being formed with at least one slot, said abutment member being pivoted to said trigger arm, said arm pivot shaft extending through said abutment member and said at least one slot of said trigger arm, and being pivoted to said trigger member, said trigger resilient member being disposed between said abutment member and said trigger arm, and resiliently biasing said trigger arm away from said arm pivot shaft.

9. The nail gun as claimed in claim 1, further comprising a magazine module and a detection module, said magazine module including a magazine housing that is connected to said muzzle module and that is adapted to receive a plurality of nails therein, and a nail feeder that is movably disposed in said magazine housing and that is adapted to move the nails into said muzzle module one at a time, said detection module including detection member that is disposed on said magazine housing and that is located on the path of movement of said nail feeder, said detection member being configured to prevent activation of the nail-driving operation when said detection member is moved by said nail feeder.

10. The nail gun as claimed in claim 9, wherein said gun body has a flow path, said nail feeder having a projection that projects toward the outside of said magazine housing, said detection module further including a valve rod that is mounted to said gun body and that is movable between an unsealing position and a sealing position, when said valve rod is at the unsealing position, said flow path being unsealed such that the activation of the nail-driving operation is permitted, when said valve rod is at the sealing position, said flow path being sealed such that the activation of the nail-driving operation is prevented, said detection member being pivoted to said magazine housing, and having a first arm portion, and a second arm portion that is located on the path of movement of said projection of said nail feeder, said first arm portion maintaining said valve rod at the unsealing position when said projection of said nail feeder is spaced apart from said second arm portion, said first arm portion permitting said valve rod to move to the sealing position when said projection of said nail feeder pushes and rotates said second arm portion.

11. The nail gun as claimed in claim 1, wherein said gun body has a first stop structure, and a second stop structure that is recessed relative to said first stop structure away from said muzzle module, said trigger member having an abutment portion that faces toward said first stop structure and said second stop structure, said abutment portion of said trigger member corresponding in position to said first stop structure when said switch member is at the repetitive firing position, and corresponding in position to said second stop structure when said switch member is at the sequential firing position.

12. An operation device adapted for use in a nail gun and for activating a nail-driving operation, the nail gun having a nail exit opening, said operation device comprising:

a contact arm disposed on the nail gun, and having an abutment front end, said contact arm being resiliently maintained at a normal position, and being operable to move away from the normal position such that said abutment front end projects relative to the nail exit opening;

a transmission member connected to said contact arm;

a trigger member pivoted to the nail gun;

a trigger arm mounted in said trigger member, and abutting against said transmission member when said trigger member is not depressed; and a switch member operable to move between a sequential firing position and a repetitive firing position, when said switch member is at the sequential firing position and when said trigger member is depressed with said abutment front end of said contact arm not being blocked, said trigger arm being configured to push said transmission member to move said contact arm away from the normal position until said trigger arm deviates from the path of movement of said transmission member such that the nail-driving operation is prevented from being activated by operation of said contact arm;

wherein when said switch member is at the repetitive firing position and when said trigger member is depressed with said abutment front end of said contact arm not being blocked, said trigger arm being configured to push said transmission member to move said contact arm away from the normal position and configured not to deviate from the path of movement of said transmission member, such that said trigger arm is moved by said transmission member to activate the nail-driving operation upon each movement of said contact arm back toward the normal position.

13. The operation device as claimed in claim 12, wherein when said switch member is at the sequential firing position and when said trigger member is depressed with said abutment front end of said contact arm being blocked, said trigger arm is blocked by said transmission member, and moves to activate the nail-driving operation.

14. The operation device as claimed in claim 12, the nail gun having a positioning hole that has an upper positioning portion and a lower positioning portion, wherein, said switch member is rotatably mounted to said trigger member, and is adapted to be movably mounted to the positioning hole of the nail gun, said switch member being positioned relative to the nail gun at the lower positioning portion of the positioning hole when said switch member is at the sequential firing position, said switch member being positioned relative to the nail gun at the upper positioning portion of the positioning hole when said switch member is at the repetitive firing position, said trigger member and said trigger arm being moved relative to the nail gun when said switch member is moved from the sequential firing position to the repetitive firing position.

15. The operation device as claimed in claim 12, further comprising an abutment member, an arm pivot shaft and a trigger resilient member, said trigger arm having a lower portion that is connected to said trigger member, and an upper portion that is opposite to said lower portion, said lower portion being formed with at least one slot, said abutment member being pivoted to said trigger arm, said arm pivot shaft extending through said abutment member and said at least one slot of said trigger arm, and being pivoted to said trigger member, said trigger resilient member being disposed between said abutment member and said trigger arm, and resiliently biasing said trigger arm away from said arm pivot shaft.

16. The operation device as claimed in claim 12, the nail gun including a cover plate, and a middle plate that cooperates with the cover plate to define a nail path therebetween, wherein, said contact arm is substantially disposed between the cover plate and the middle plate, and is adapted to cooperate with the cover plate to define the nail exit opening.

17. The operation device as claimed in claim 16, further comprising at least one safety resilient members, said at least one safety resilient members having two opposite ends respectively abutting against said contact arm and said middle plate, said at least one safety resilient members resiliently biasing said contact arm for maintaining said contact arm at the normal position.

18. The operation device as claimed in claim 12, the nail gun having a first stop structure, and a second stop structure that is recessed relative to the first stop structure away from the nail exit opening, wherein, said trigger member has an abutment portion that faces toward the first stop structure and the second stop structure, said abutment portion of said trigger member being adapted to correspond in position to the first stop structure when said switch member is at the repetitive firing position, and to correspond in position to the second stop structure when said switch member is at the sequential firing position.

* * * * *